US006424814B2

(12) United States Patent
Otsuka et al.

(10) Patent No.: US 6,424,814 B2
(45) Date of Patent: Jul. 23, 2002

(54) IMAGE FORMING APPARATUS USING SHAPED TONER PARTICLES AND TRANSFER ROLLER PRESSURE FOR FINE IMAGE QUALITY

(75) Inventors: Yasumasa Otsuka, Yokohama; Daizo Fukuzawa, Matsudo; Hisashi Nakahara, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/789,637

(22) Filed: Feb. 22, 2001

(30) Foreign Application Priority Data

Feb. 25, 2000 (JP) ..... 2000-048436
Jan. 18, 2001 (JP) ..... 2001-010300

(51) Int. Cl.[7] ..... G03G 15/16; G03G 15/08; G03G 13/01; G03G 9/00

(52) U.S. Cl. ..... 399/313; 399/27; 399/252; 430/45; 430/109; 430/110; 430/111

(58) Field of Search ..... 399/27, 28, 222, 399/252, 313; 430/45, 109, 110, 111

(56) References Cited

U.S. PATENT DOCUMENTS 2,297,691 A 10/1942 Carlson ..... 95/5
4,302,093 A * 11/1981 Landa ..... 399/313
5,159,393 A * 10/1992 Hiroshima et al. ..... 399/313
5,321,482 A 6/1994 Yano et al. ..... 355/299
5,712,072 A * 1/1998 Inaba et al. ..... 430/110
5,712,073 A 1/1998 Katada et al. ..... 430/110
6,077,636 A * 6/2000 Moriki et al. ..... 430/45

FOREIGN PATENT DOCUMENTS

| | | |
|---|---|---|
| JP | 36-10231 | 7/1936 |
| JP | 42-023910 | 11/1942 |
| JP | 43-24748 | 10/1943 |
| JP | 56-1394510 | 4/1981 |
| JP | 59-53856 | 3/1984 |
| JP | 56-61842 | 4/1984 |
| JP | 10-3179 | 1/1998 |

* cited by examiner

*Primary Examiner*—Sophia S. Chen
*Assistant Examiner*—Hoang Ngo
(74) *Attorney, Agent, or Firm*—Fitzpatrick, Cella, Harper & Scinto

(57) ABSTRACT

An image forming apparatus is disclosed in which a specific toner is used, and a transferring means has a transfer roller which is in contact with the surface of an electrostatic image bearing member and rotates when the electrostatic image bearing member rotates. The toner is comprised of particles which have a weight average particle diameter of 4 to 12 $\mu$m, and in a circularity distribution for particles 3 $\mu$m or more in circle-equivalent diameter which are included in the toner, particles having a circularity of 0.90 or more account for 90% by number or more.

17 Claims, 3 Drawing Sheets

IMAGE FORMING APPARATUS USING SHAPED TONER PARTICLES AND TRANSFER ROLLER PRESSURE FOR FINE IMAGE QUALITY

BACKGROUND OF THE INVENTION

1. Field of the Invention

The present invention relates to an image forming apparatus which has an electrostatic image developing toner to develop an electrostatic image in an image forming process, such as electronic photography, electrostatic recording, or electrostatic printing.

2. Related Background Art

As described in U.S. Pat. No. 2,297,691 and Japanese Patent Publications No. 42-23910 and No. 43-24748, many processes of electrophotography are known. These processes typically consist of the following steps: (1) the surface of an electrostatic image bearing member using a photoconductive substance is uniformly charged by various means, (2) an electrostatic image is formed on the image bearing member, (3) the electrostatic image is developed using a toner, (4) the toner image is transferred onto a transfer material, such as paper, as needed, (5) the image is fixed by heating, pressurizing, or both of them or with solvent vapor or the like to obtain a print, and (6) by various methods, the image bearing member is cleaned of toner which is left untransferred onto the electrostatic image bearing member. These steps are repeated.

Methods for removing residual toner from an electrostatic image bearing member, which include a blade cleaning method, a fur brush cleaning method, and a magnetic brush cleaning method, commonly bring a cleaning member into contact with an electrostatic image bearing member.

Many contact charging methods have recently been proposed which bring a charging member into contact with the surface of an electrostatic image bearing member to apply a voltage produced by superposing a DC voltage and an AC voltage onto the image bearing member. These methods allow a lower voltage to be used, compared with the conventional corona charging method. Contact charging methods also have the advantage of producing a small amount of ozone. For example, as shown in FIG. 4, contact charging methods drive a charging roller 2, or a charging member, which is brought into contact with an electrostatic image bearing member (a photosensitive drum) I, to apply a voltage (Vac+Vdc) produced by superposing an AC voltage and a DC voltage to the charging roller 2 so that the photosensitive drum 1 can be uniformly charged.

As understood from the foregoing, the charging roller 2 must be kept electrically conductive. A conventional charging roller is a core around which an electrically conductive elastic member is formed by dispersing carbon in elastic rubber, such as EPDM and NBR.

In recent years, expanded rubber has been often used to reduce vibration noise which is produced because of an AC voltage applied for charging. A transfer roller, or a core covered with elastic rubber, such as electrically conductive expanded EPDM, is used for image transfer. Because contact charging methods press toner against an electrostatic image bearing member, such as a photosensitive member, toner packing occurs, thus causing a phenomenon called "hollow images": the middle of an image is not transferred but left on an electrostatic image bearing member.

To solve this problem, the pressure under which the transfer roller is pressed down is reduced, or the transfer material speed and electrostatic image bearing member speed are made to differ from each other to scrape the middle of an image using a shear force and transfer the scraped part onto a transfer material.

However, if transfer roller pressure is reduced, an image tends to be blurred due to shock which is caused by a transfer material passing through other transport rollers. On the other hand, if the electrostatic image bearing member speed and transfer material speed differ from each other, the image magnification must be adjusted by controlling the circumferential speed of the transfer roller, which exhibits higher transport performance than the electrostatic image bearing member. The transfer roller easily wears because of the circumferential speed difference. Making many prints causes the outer diameter of the transfer roller to decrease, thus reducing its circumferential speed, so that the transfer roller becomes less effective in preventing "hollow images."

To meet a growing demand from users for energy saving, it is better that a toner is packed in paper fibers, or toners are packed in each other so that fixing performance can be improved, that is, heat is transferred more effectively during fixing. Toners (or particles) tightly stuck together advantageously prevent a phenomenon called "smeared images with trailing edges": the scattering on a toner image occurs toward the upstream direction of transport due to steam produced by fixing. However, pressure cannot be applied due to the above-described problem of transferred-image quality.

SUMMARY OF THE INVENTION

An object of the present invention is to provide an image forming apparatus which solves the above-described problems.

Another object of the present invention is to provide an image forming apparatus which forms images free from "hollow images" and blurred images for a long period of time and prevents image deterioration after image transfer.

Still another object of the present invention is to provide an image forming apparatus which fixes an image using less energy and prevents smeared images with trailing edges during fixing.

The present invention provides an image forming apparatus, comprising:

(i) an electrostatic image bearing member for bearing an electrostatic image;

(ii) developing means having a toner for forming a toner image by developing an electrostatic image carried on the electrostatic image bearing member; and (iii) transferring means for transferring the toner image from the electrostatic image bearing member onto a transfer material, wherein particles constituting the toner are 4 to 12 $\mu$m in weight average diameter, and in a circularity distribution for particles 3 $\mu$m or more in circle-equivalent diameter which are included in the toner, particles having a circularity a of 0.90 or more account for 90% by number or more, the circularity a being given by the following formula:

$$\text{Circularity } a = \frac{L_0}{L}$$

where $L_0$: The circumference of a circle which has the same projected area as a particle image L: The perimeter of the particle image, and the transferring means has a transfer roller which is in contact with the surface of the electrostatic image bearing member and rotates as the electrostatic image bearing member moves.

DETAILED DESCRIPTION OF THE PREFERRED EMBODIMENTS

Figure 1:
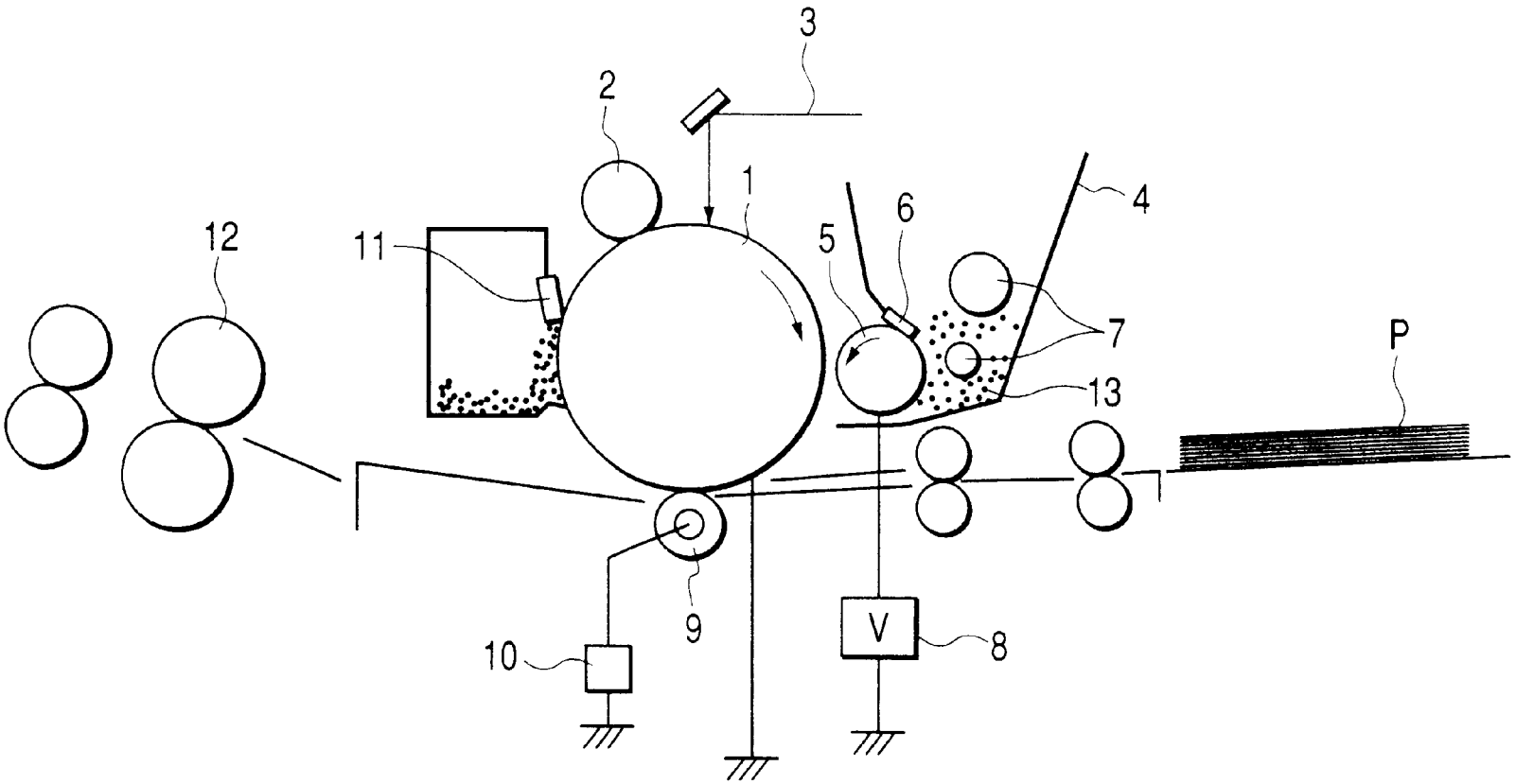
FIG. 1 is a schematic view illustrating an image forming apparatus of the present invention.

The present invention is based on the following findings made by the inventors through intensive study of the above-described problems of "hollow images" and "blurred images": (1) using as transferring means a transfer roller which is in contact with the surface of an electrostatic image bearing member and follows the image bearing member as it moves allows transfer roller to be prevented from wearing, (2) using a toner whose particles are 4 to 12 μm in weight average diameter and have a certain circularity distribution reduces slip resistance between the toner and electrostatic image bearing member, thus preventing hollow images from occurring during image transfer, (3) this advantage also allows an image to be transferred in a pressure range in which an image could not be transferred, preventing blurred images from occurring, (4) a combination of these advantages solves the above-described problems, that is, provides images free from hollow images and blurred images for a long period of time and prevents image deterioration after image transfer, and (5) the combination also allows an image to be fixed using less energy and prevents "smeared images with trailing edges" during fixing.

The present invention having the above described features can sufficiently exhibit meritorious effects at high speeds and high durability which are highly demanded in recent years.

The present invention will be specifically described below.

To find the circularity distribution for particles 3 μm or more in circle-equivalent diameter which are included in the toner used for the present invention, their circularity a is given by the following formula:

$$\text{Circularity } a = \frac{L_0}{L}$$

where $L_0$: The circumference of a circle which has the same projected area as a particle image L: The perimeter of the particle image In the toner according to the present invention, its particles are 4 to 12 μm, preferably 4 to 9 μm, and more preferably 4 to 8 μm in weight average diameter and, in the circularity distribution for particles 3 μm or more in circle-equivalent diameter, particles having a circularity of 0.90 or more are 90% or more, preferably 92% or more, and more preferably 95% or more, based on the number of particles.

If the particles included in the toner are less than 4 μm in weight average diameter, its fluidity decreases, and its adhesion increases, thus resulting in poor development, transfer, and cleaning performance. On the other hand, if the particles included in a toner are more than 12 μm in weight average diameter, a problem arises in image reproduction. If particles 3.17 μm or less in weight average diameter account for more than 30% of all the particles included in a toner, cleaning performance deteriorates, and fogging are liable to occur.

The weight average diameter of particles included in a toner according to the present invention is measured using a Coulter counter TA-II or a Coulter multisizer (made by Coulter Electronic, Inc.). Using first class grade sodium chloride, a 1% NaCl solution is prepared as an electrolyte. For example, ISOTON R-II (from Coulter Scientific Japan) can be used.

One-tenth to five milliliters of a dispersant, a surface-active agent (preferably an alkylbenzene sulfonate), is added to 100 to 150 ml of the electrolyte, then two to twenty milligrams of a sample is added to the mixture. The electrolyte, in which the sample is suspended, is dispersed for about 1 to 3 minutes using an ultrasonic disperser. Using the above-described measuring instruments and a 100-μm aperture, the volume occupied by particles 2 μm or more in diameter is measured, and the particles are counted to find a volume distribution and a number distribution.

For the present invention, the circle-equivalent diameter, circularity, and circularity distribution were used as a simple and easy way for quantitatively expressing the shape of a toner particle. Measurements were made using an FPIA-1000 flow type particle image measuring device (from Toa Iyo Denshi), and the above-described parameters were computed from the following equations.

Circle-equivalent diameter=(projected particle area/$\pi$)$^{1/2}$×2

Circularity=(circumference of circle whose area is equal to projected particle area)/(perimeter of projected particle image)

where the "projected particle area" is the binarized area of a toner particle image, and the "perimeter of a projected particle image" is the perimeter of a contour given by connecting edge points on the toner particle image.

If particles with a circularity of 0.90 or more are less than 90% by number, slip resistance between the toner and electrostatic image bearing member is so high that hollow images are liable to occur during image transfer.

For the present invention, to produce a toner with the above-described circularity distribution, the following methods may be used: (1) a hot-bath method which disperses in water and heats toner particles produced by a grinding method, described later, (2) a method which makes particles spherical by a heat-treating method passing them through hot-air flow or a mechanical-impact method giving them mechanical energy, (3) a method described in Japanese Patent Publication No. 56-13945 or the like which produces spherical toner particles by atomizing a molten mixture in the air using a disk or a multi-fluid nozzle, (4) a method which produces polymerized toner particles using a suspension polymerization method described in Japanese Patent Publication No. 36-10231, Japanese Patent Application Laid-Open No. 59-53856, and Japanese Patent Application Laid-Open No. 59-61842, (5) a dispersion polymerization method which produces polymerized toner particles, using a water-based organic solvent in which a monomer is soluble and a polymer slightly soluble, and (6) emulsion polymerization methods represented by the soap-free polymerizing method which produce toner particles by polymerization, using a water-soluble polar polymerization initiator.

A method for producing toner particles by grinding comprises the following steps: (1) toner components, such as a binder resin, a colorant, and a release agent or a charge control agent as needed, are uniformly mixed using a mixer, such as a Henshel mixer or a medium disperser, (2) the mixture is kneaded using a kneader, such as a pressurization kneader or an extruder, (3) after cooling the mixture, it is roughly ground using a grinder, such as a hammer mill, (4) the ground mixture is impacted mechanically or under a jet stream against a target, and pulverized to produce toner particles with a desired diameter, and (5) particle size distribution is made sharper.

In the present invention, since a toner containing particles with a circularity of 0.90 or more in 90% by number or more can be effectively produced, a polymerizing method is preferably used to produce the toner. Specifically, the following method can be used to produce a toner.

Using a homogenizer or an ultrasonic dispenser, a release agent, a colorant, a charge control agent, a polymerization initiator, and other agents are uniformly dissolved or dispersed in a polymerizable monomer to produce a monomer system. Then the monomer system is dispersed in water containing a dispersion stabilizing agent, using an ordinary stirrer, a homomixer, or a homogenizer. When particles are produced, it is preferable that stirring speed and stirring time are so adjusted that monomer drops are of the same size as desired particles. The mixture has only to be stirred to the extent that the particle state is maintained under the action of the dispersion stabilizing agent and that particles are prevented from sedimenting. Polymerization temperature is commonly set at 40° C. or more, typically 50 to 90° C.

The circularity distribution can be controlled according to the type of dispersion stabilizing agent, its amount, stirring capability, pH of water, and polymerization temperature.

To control environmental stability of development, the easiness of cleaning of an electrostatic image bearing member, and toner resistance, metal oxide particles, fine inorganic particles, and fine resin particles which are one or more digit smaller in diameter than toner particles are mixed as external additives, as described in Japanese Patent Application Laid-Open No. 10-3179.

FIG. 1 schematically shows an image forming apparatus of the present invention. Referring now to the figure, the present invention will be described below.

Reference numeral 1 indicates an electrostatic image bearing member. A primary charging apparatus 2, an exposure optical system 3, a developing apparatus 4 with a toner carrier 5, a transferring apparatus 9, and a cleaning apparatus 11 are disposed around the electrostatic image bearing member 1.

The image forming apparatus uniformly charges the surface of the electrostatic image bearing member 1, a photosensitive member, by the use of the primary charging apparatus 2, and carries out imagewise exposure by the use of the exposure optical system 3 to form an electrostatic latent image on the surface of the electrostatic image bearing member 1.

Using a toner layer thickness regulating member 6, a toner coat is formed on the toner carrier 5, which contains a magnet. Using bias applying means 8, a developing unit develops the electrostatic image on the electrostatic image bearing member 1 while applying an alternate bias, a pulse bias, and/or a DC bias between an electrically conductive base of the electrostatic image bearing member 1 and the toner carrier 5.

A transfer roller 9 is in contact with the electrostatic image bearing member and follows the image bearing member as it moves. Bias applying means 10 applies a transfer bias to the transfer roller 9 to impart a charge having a polarity opposite to the polarity of the toner from the back surface of transfer paper P, thus electrostatically transferring the toner image onto the paper P.

When no transfer paper P is present and no image is transferred onto paper, driving force provided from the surface of the electrostatic image bearing member rotates the transfer roller as the image bearing member moves, with the roller in direct contact with the electrostatic image bearing member. On the other hand, when transfer paper P is present and an image is transferred onto the transfer paper, driving force provided from the surface of the transfer paper P rotates the transfer roller, with the roller in contact through the transfer paper P with the electrostatic image bearing member. In this case, if the length of the transfer roller is larger than the width of the transfer paper P (the dimension of the transfer paper P in parallel with the length of the transfer roller, which paper is conveyed during image transfer), the parts of the transfer roller which project beyond the ends of the transfer paper P come in direct contact with the surface of the electrostatic image bearing member, so that driving force provided from the surface of the electrostatic image bearing member as well as driving force provided from the surface of the transfer paper P rotate the transfer roller.

Thus, for the present invention, the transfer roller is rotated in two modes as the electrostatic image bearing member moves: (1) the transfer roller is directly rotated, and (2) the transfer roller is rotated through the transfer paper P.

A toner produced by a conventional grinding method may often include less than 90% by number of particles with a circularity a of 0.90 or more, so that slip resistance F1 between the toner and a photosensitive drum is almost equal to rolling resistance F2 between toner particles. Thus, to prevent hollow images from occurring, the transfer roller speed must be made to differ from the photosensitive drum speed so that a shearing force is produced at the interface between the toner layer and photosensitive drum.

Thus a conventional image forming apparatus rotates the transfer roller so that its circumferential speed is about 5% higher than that of the photosensitive drum. However, if the transfer roller wears due to friction between the roller and transfer material, the outside diameter of the roller decreases, so that the circumferential speed difference is lost, resulting in decrease in the effect on the prevention of hollow images.

Because a force produced by gear engagement on the driving side interferes with pressure which is applied to the photosensitive drum, the partial pressure is set to be relatively higher. To balance right and left transporting forces, right and left pressures against the transfer roller must be found empirically.

The transfer roller rotates at a speed differing from the speed of the photosensitive drum, and toner and paper dust deposited on the transfer roller act as abrasive, accelerating transfer roller wear.

Only a slight slip resistance F1 is produced between layers of the toner as used in the present invention which includes more than 90% by number of particles with a circularity of 0.90 or more. In addition, the circularity of particles included in the toner is so high that the particles can be packed more closely. For these reasons, by setting rolling resistance F2 between the particles sufficiently high, hollow images can be prevented from occurring.

To make F2 higher than F1, an appropriate pressure must be applied to the transfer roller.

Thus the transfer roller is in contact with the electrostatic image bearing member at a pressure of preferably 0.5 to 10 $N/cm^2$, and more preferably 0.56 to 2.30 $N/cm^2$.

Figure 3:
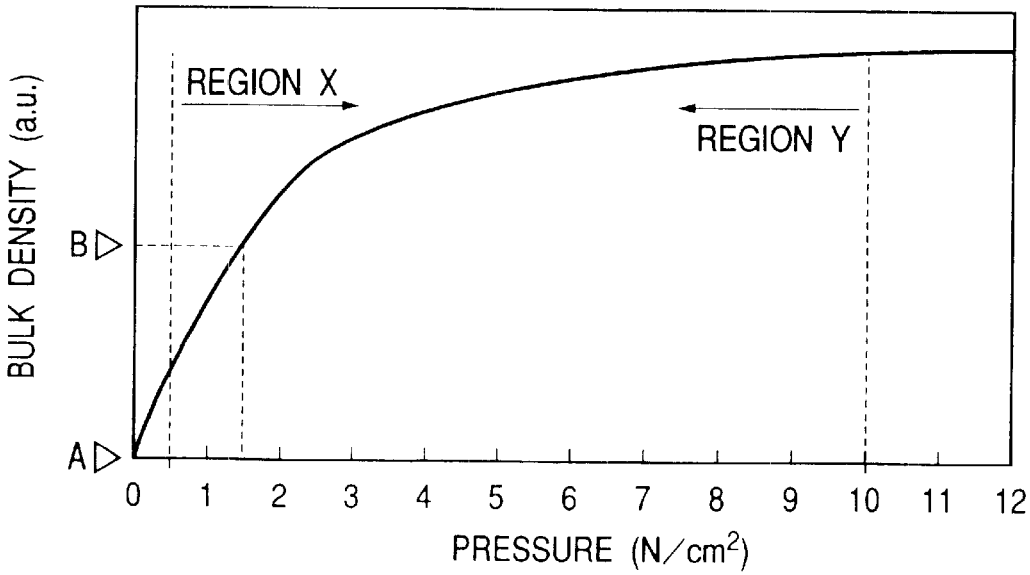
FIG. 3 is a drawing illustrating a relationship between pressure and bulk density.
Figure 4:
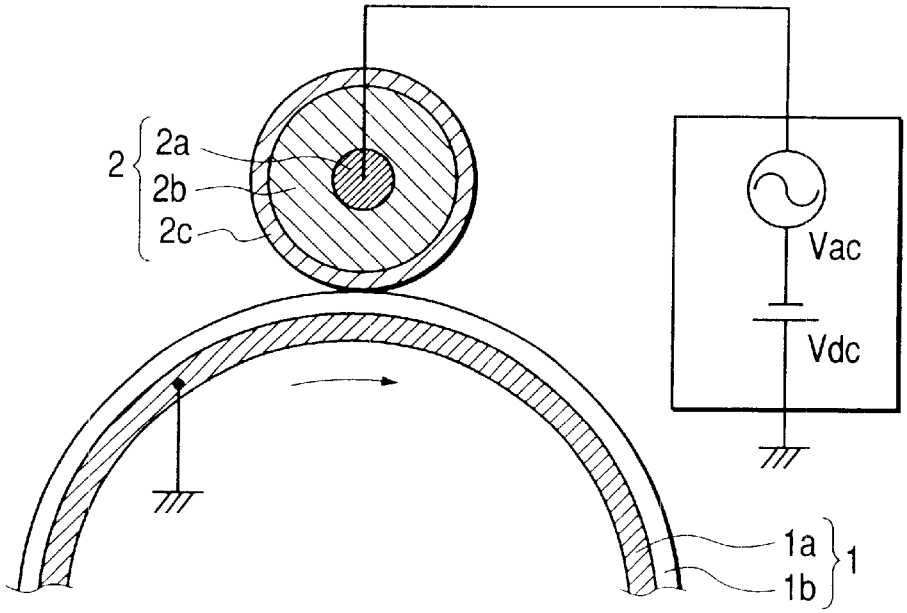
FIG. 4 is a drawing illustrating a charging roller.

FIG. 3 shows a relationship between pressure ($N/cm^2$) and bulk density (arbitrary unit). In FIG. 3, region X is a region in which there is no problem of blurred images and smeared images with trailing edges, and region y is a region in which problems of hollow images (or blank areas) do not occur. If the pressure is less than 0.5 $N/cm^2$, a packing force cannot be obtained which is large enough to make F2 higher than F1, so that not only do the blur and trailing edges occur, as shown in FIG. 3, but transferability of a toner decreases if its particles have high circularity. On the other hand, if the pressure is more than 10 $N/cm^2$, adhesion between toner particles and the photosensitive drum increases, thus promoting hollow images. It is essential for the pressure to range from 0.5 to 10 $N/cm^2$. The transfer roller, which rotates as the electrostatic image bearing member moves, hardly wears, and thus its outside diameter does significantly, so that feed speed is not adversely affected.

Since the present invention does not require the transfer roller to be driven, the right and left pressures on the transfer roller may be the same. A conventional image forming apparatus has a photosensitive-drum flange integrated with gears, while the image forming apparatus according to the present invention does not need a line of gears which drive the transfer roller. Thus the depth of an image forming apparatus can be reduced.

For the present invention, it is preferable that the following relationship is established to prevent image aberration and stretched images when the transfer roller rotates as the electrostatic image bearing member moves.

That is, if transfer material is not tensioned, the following inequality is preferably met:

$$\{f_1(L-L')+f_2\times L'\}\times l_1>M+f_3\times l_2$$

where $f_1$ is the rotating force directly transmitted from the photosensitive drum to the transfer roller, $f_2$ is the rotating force transmitted from the photosensitive drum through transfer paper to the transfer roller, $l_1$ is the radius of the transfer roller, L is the length of the transfer roller, L' is the width of transfer material, M is transfer roller moment, $f_3$ is the frictional resistance of the transfer roller bearings, and $l_2$ is the radius of the transfer roller shaft.

If a driving force from transfer material is reversed, for example, when transfer material is back-tensioned, the following inequality must be met:

$$\{f_1(L-L')-f_2\times L'\}\times l_1>M+f_3\times l_2$$

where $f_1$ is the rotating force directly transmitted from the photosensitive drum to the transfer roller, $f_2$ is the rotating force transmitted from the photosensitive drum through transfer paper to the transfer roller, $l_1$ is the radius of the transfer roller, L is the length of the transfer roller, L' is the width of transfer material, M is transfer roller moment, $f_3$ is the frictional resistance of the transfer roller bearings, and $l_2$ is the radius of the transfer roller shaft.

The above-described parameters are difficult to measure. Therefore, it is preferable that designs are so made that the surface speed of the transfer roller which is measured using an LV-20Z laser Doppler speedometer (from Canon Inc.) is 1% or less lower than that of the photosensitive drum, that is, the circumferential speed of the transfer roller is 99 to 100% of that of the photosensitive drum.

If the difference in surface speed between the transfer roller and photosensitive drum exceeds 1%, aberration or shrinkage on an image may undesirably occur.

To set the surface speed of the transfer roller as described above, it is preferred that the radius of the shaft retainer (or a bearing) is made as small as 2 to 4 mm or provided with a ball bearing.

Passing through a fixing apparatus 12 transfer paper P onto which toner is transferred provides a fixed image.

Toner which is left after transfer is removed by a cleaning apparatus 11, and then primary charging and subsequent steps are repeated.

Figure 5:
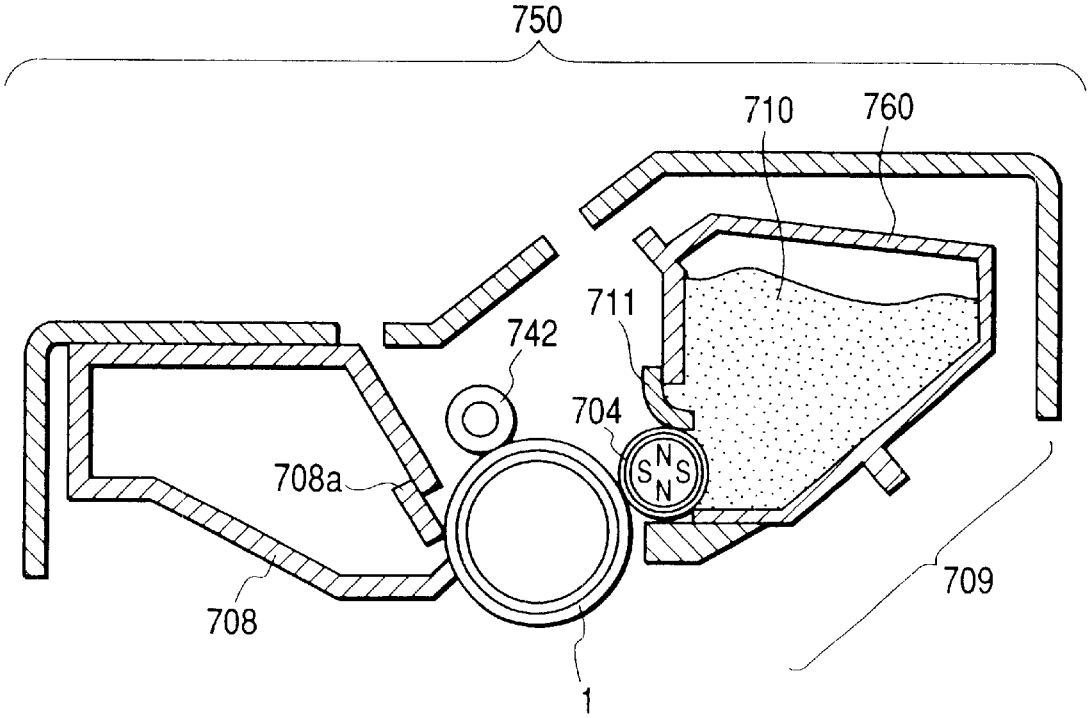
FIG. 5 is a drawing illustrating a process cartridge.

An image forming apparatus of the present invention may be a unit (a process cartridge) as shown in FIG. 5, where the transfer step is not illustrated. The unit is comprised of at least a developing means and an electrostatic image bearing member which are integrated into a cartridge. The unit may be so adapted as to be detachable from an image forming apparatus body (for example, a copying machine or a laser printer).

By way of example, a unit, an assembly of developing means 709, a drum-like electrostatic image bearing member (photosensitive drum)l, a cleaner 708 with cleaning blades 708*a*, and a primary charger (charging roller) 742 with contact charging means will be described below.

The developing means 709 has an elastic blade 711 and a toner 710 in a toner container 760. The toner 710 is used, and at the time of development, a predetermined electric field is generated between the photosensitive drum 1 and a toner carrier (developing sleeve) 704 by a bias from the bias applying means, so that an image is appropriately developed. Thus, the distance between the photosensitive drum 1 and developing sleeve 704 is important.

It is preferable that a transfer roller for an image forming apparatus of the present invention have an Asker-C hardness of 25 to 70. A hardness of less than 25 causes the contact area between the transfer roller and photosensitive drum to increase, resulting in apparently reduced transfer roller resistance. Consequently, memory is likely to occur on the drum due to excessive current. On the other hand, a hardness of more than 70 causes the contact area between the transfer roller and photosensitive drum to decrease, resulting in apparently increased transfer roller resistance. Consequently, scattering (or black spots around images) tends to occur due to insufficient current at low humidity.

To give a transfer roller a preferable hardness, the roller is preferably produced by covering a core made of iron, SUS, or the like with solid or spongy elastic material, such as EPDM, silicone, NBR, or urethane, containing electrically conductive carbon or an ionic conductivity imparting agent, whose cross-link density, blowing diameter, and filler amount are properly adjusted.

It is desirable that the transfer roller is in contact with the electrostatic image bearing member at a pressure of 0.5 to 10 $N/cm^2$. A pressure of less than 0.5 $N/cm^2$ tends to cause blurred images or smeared images with trailing edges, and a pressure of more than 10 $N/cm^2$ tends to cause hollow images during transfer.

To give the charging member an Asker-C hardness of 70 or less, it is preferable that the lower layer of the member is composed preferably of an elastic layer or an electrically conductive layer which is made of thermoplastic elastomer or flexible rubber or that the lower layer is made of electrically conductive sponge.

To provide stable charging performance with no leak, the upper layer of the charging member which is in contact with the electrostatic image bearing member preferably has high resistance and is 50 to 200 $\mu$m thick.

To prolong the life of the electrostatic image bearing member for the present invention and reduce the frictional resistance of the surface of the image bearing member to increase transferability, the image bearing member is preferably a lamination consisting of at least an electrically conductive support, a charge generating layer, and a charge transporting layer and has fluorine and/or silicon atoms on the surface.

The fluororesin used in the present invention is appropriately selected from known fluororesins including, for example, homopolymers and copolymers of tetrafluoroethylene, chlorotrifluoroethylene, hexafluoropropylene, vinyl fluoride, vinylidene fluoride and dichlorodifluoroethylene. Fluorocarbon may also be used for the present invention.

In the present invention, there may be used a fluorine-type polymer, or a fluorine-type surface-active agent, a fluorine-type macromonomer, a block polymer or a graft polymer containing a fluorine-type segment produced by copolymerizing a non-fluorine-type polymerizable monomer and a fluorine-containing polymerizable monomer, alone or in combination with the above-described fluororesins.

The following silicone-type compounds may be used in the present invention: a monomethylsiloxane three-dimensional cross-linked compound, a dimethylcysiloxane-monomethylsiloxane three-dimensional cross-linked compound, ultrahigh-molecular-weight polydimethylsiloxane, a silicone-type surface-active agent, a silicone-type macromonomer, a block polymer or a graft polymer containing polydimethylcyclohexene segment, terminal-modified polydimethylsiloxane, etc. Three-dimensional cross-linked compounds whose fine particles have a volume average diameter ranging from 0.01 to 5 $\mu$m can be used for the present invention. Polydimethylsiloxane compounds with a molecular weight ranging from 3,000 to 5,000,000 can be preferably used for the present invention.

Material in fine-particle form is dispersed as a photosensitive layer composition together with a binder resin.

A fluorine compound and a silicone compound may be preferably used in the present invention if these compounds account for 50% by weight or less of an organic photosensitive layer (OPC) composition. It is more preferable that the compounds account for 0.5 to 50% by weight. These particles, added to the electrostatic image bearing member, enhance the surface lubricity to further prevent hollow images from occurring.

As described above, the toner used in the present invention consists of particles 4 to 12 pm in weight average diameter and includes 90% by number or more of particles with a circularity a of 0.90 or more, so that an image can easily be transferred from the electrostatic image bearing member onto transfer material without hollow images even if there is no difference in speed between the electrostatic image bearing member and transfer roller. Thus, according to the present invention, even when the rotation of the transfer roller is driven by the rotation of the electrostatic image bearing member, a high transfer efficiency can be realized and hollow images can be prevented from occurring.

In addition, in the present invention, since the toner is packed into paper in a non-heated transfer region, heat conduction is improved in a heated region (preheated region where a fixing film and transfer material are close to each other) by the time a transfer material holding the toner is introduced into a nip, thereby improving fixing performance and preventing smeared images with trailing edges due to steam.

EXAMPLES

Using specific examples, the present invention will be described below. However, the present invention is not limited to these examples.

Example 1

| | |
|---|---|
| Polymerizable monomer | 100 weight parts |
| Colorant | 7.5 weight parts |
| Polymerization initiator | 5 weight parts |
| Negative-charge controlling agent | 1.5 weight parts |
| Wax | 15 weight parts |

These materials were charged into a water-based medium containing a dispersant. While it was stirred, the mixture was heated to granulate the polymerizable monomer composition. Then the composition was placed in a reaction container and heated with stirring to react. After polymerization was completed, the particles were filtered, washed, and dried to obtain toner particles. Fine hydrophobic silica powder was added to the toner particles to obtain toner I which consisted of particles 6.0 $\mu$m in weight average diameter and included 98% by number or more of particles with a circularity of 0.90 or more. The toner contained 2% by number of particles 3.17 $\mu$m or less in diameter.

Toner I was placed in the development container of a unit. The unit was installed in a modified Canon LBP309GII, whose throughput was changed from 16 images/min to 30 images/min, to develop images and evaluate them. The processing speed was 200 mm/sec.

Figure 2:
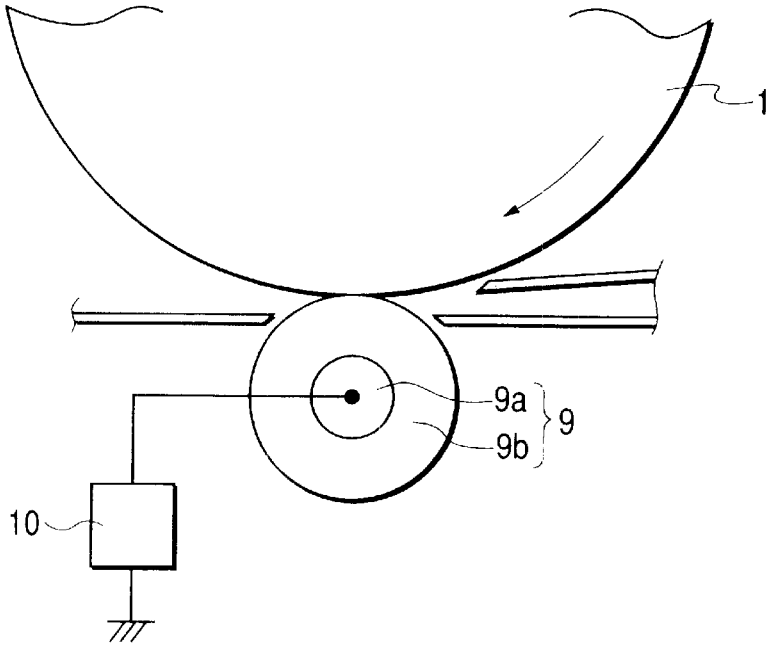
FIG. 2 is an enlarged view of a transfer roller.

In this Example used was a transfer roller having a metal core 9*a* around which an expanded electrically conductive EPDM rubber layer 9*b* was formed as shown in FIG. 2. The transfer roller was 15 mm in outside diameter (the core 9*a* was 6 mm in diameter, and the layer 9*b* was 4 mm thick) and had an Asker-C hardness of 30 (this value was the average of 9 values obtained by making 3 measurements each in the middle and at the right and left under a load of 500 g using ASKER-C hardness meter).

The power-supply side shaft retainer of the transfer roller was 3 mm in radius and made of electrically conductive polyacetal resin, and the sliding part was 3.05 mm or more in radius. The non-power-supply side shaft retainer was 3 mm in radius and made of insulating polyacetal resin, and the sliding part was 3.05 mm or more in radius.

In this Example, a charging roller which is in contact under a predetermined pressure with a photosensitive drum rotates as the photosensitive drum rotates. A power supply applied to the charging roller a voltage (Vac+Vdc) produced by superposing an AC voltage and a DC voltage (Vdc, the peak-to-peak voltage Vpp, and the frequency Vf were −700 V, 1800 V, and 1000 Hz, respectively) to uniformly charge the photosensitive drum so that VD=−700 V.

The surface of the charged photosensitive drum was scanned according to an image pattern by means of a laser beam, which was focused on minute spots, to form an electrostatic latent image of VL=−170 V. Then an AC bias f of 1800 Hz, a peak-to-peak voltage Vpp of 1400 V, and a DC bias Vdc of −500 V were applied between the image and a developing sleeve holding the toner to develop the electrostatic latent image on the surface of the organic photoconductor (OPC), thereby obtaining a toner image.

Changes in the toner image formed were observed as the pressure under which the transfer roller with the electrically conductive elastic layer was in contact with the image was varied from 1 to 80 N/cm$^2$. The pressure was adjusted by changing nip pressure and spring pressure according to the hardness of the transfer roller. The transfer roller was adapted to rotate as the photosensitive drum rotated. To determine the pressure, the nip area is needed. However, the distance between the electrostatic image bearing member and the transfer roller core is measured to compute the pressure, using CAD or the like. For example, a transfer roller 14 mm in diameter which has an Asker-C hardness of 30 is pressed against a photosensitive drum 24 mm in diameter at 10 N in total. Because the width and length of the nip are found to be 4 mm and 220 mm, respectively, the area of the nip and the contact pressure can be calculated. In this case, the pressure is found to be about 1.1 N/cm$^2$.

Using a transferring apparatus, which was in contact with the OPC drum, the image was transferred onto transfer paper by positively charging the paper from behind it, and the image was allowed to pass through a heating/pressurizing apparatus to obtain a fixed image. The temperature of a heating roller of the heating/pressurizing apparatus, the total pressure at which the heating and pressurizing rollers were pressed against each other, and the width of the nip were set to be 185° C., 100 N, and 4 mm, respectively.

An intermittent image forming test was performed under the following environments: (1) 15° C. and 10%RH, (2) 23° C. and 50%RH, and (3) 32.5° C. and 80%RH. The print speed was set to be 1 sheet/2 sec.

As a result, under all the environments, no hollow image occurred at a pressure of 10 N/cm$^2$ or less. In addition, no blurred images occurred at a pressure of 0.5 N/cm2 or more. When the transfer roller applied a pressure of 0.5 to 10 N/cm$^2$ to the photosensitive drum, the transfer roller rotated at 99.1 to 99.9% of the circumferential speed of the photosensitive drum as the drum rotated.

When the transfer roller was pressed against the photosensitive drum at a pressure of 0.5 N/cm$^2$ or more, smeared images with trailing edges were reduced at a high temperature and humidity environment. As shown in FIG. 3, the bulk density of the toner is set to be A when not pressurized and to B when transferred, so that the toner is thoroughly packed before entering the fixing apparatus, thereby reducing the thickness of toner deposits and tightly sticking toner particles together.

In order to carry out the above, a pressure of more than 0.5 N/cm2 or more must be applied. Conventional toner did not allow such a high pressure to be applied. Such a high pressure also causes toner particles to come in close contact with each other, increasing thermal conductivity. In addition, since no heat air between toner particles, fixing performance was improved by about 5%. The "fixing performance" is defined as a density change divided by density, which change is caused by rubbing Silbon C paper against a sample image under a pressure of 0.4 N/cm$^2$.

For the example, transfer efficiency, which is defined as follows, was 95% by weight. Transfer efficiency (% by weight)=[(weight of toner transferred onto transfer material)/(weight of developed toner)]×100

Comparative Example 1

| | |
|---|---|
| Binder resin | 100 weight parts |
| Colorant | 7.5 weight parts |

-continued

| | |
|---|---|
| Negative-charge controlling agent | 1.5 weight parts |
| Wax | 15 weight parts |

Using a kneader, these materials were melted and kneaded. The resulting mixture was roughly ground using a grinder, and pulverized using a pulverizer and then classified by air separation, obtaining toner particles. As is the case with Example 1, fine hydrophobic silica powder was added to the toner particles to produce toner II which consisted of particles 6.0 $\mu$m in weight average diameter and included 85% by number particles with a circularity of 0.90 or more.

When an image was transferred using the toner II under the same conditions as in Example 1, transfer efficiency was found to be 85% by weight or less, and toner use efficiency was found to be excessively low. Because the transfer roller rotated as the electrostatic image bearing member moved, the roller did not satisfactorily prevent hollow images, that is, the roller did not serve the purpose.

Example 2

Toner particles II obtained in the same way as in Comparative example 1 were made spherical by mechanically impacting them. As is the case with Example 1, fine hydrophobic silica powder was added to the toner particles to produce toner III which consisted of particles 6.2 $\mu$m in weight average diameter and included 90% by number particles with a circularity of 0.90 or more.

When an image was transferred using toner III under the same conditions as in Example 1, transfer efficiency was found to be 92% by weight or more, and toner use efficiency was found to be 85%. Although the transfer roller rotated as the electrostatic image bearing member moved, the roller satisfactorily prevented hollow images.

Comparative Example 2

A toner which consists of particles having the same weight average diameter as the particles of toner I and including 85% by number particles with a circularity of 0.90 or more was used, and the transfer 20 roller was driven so that its surface speed was 1% higher than that of the photosensitive drum. When pressure was changed under the same conditions as in Example 1 except the above-described conditions, blurred images occurred at a transfer roller contact 25 pressure of 0.5 N/cm$^2$ or less, and hollow images occurred at a transfer roller contact pressure of 0.3 N/cm$^2$ or more. On the other hand, transferability increased at a transfer roller contact pressure of 0.6 N/cm$^2$ or more, and smeared images with trailing edges were reduced at a transfer roller contact pressure of 0.4 N/cm2 or more. As described above, in the comparative example, rotating the transfer roller as the electrostatic image moves did not provide a range of transfer roller contact pressure which solves all the problems.

Example 3

Because a toner and the transfer roller were used under the same conditions as in Example 1, the toner and transfer roller are not described below.

In this Example, a photosensitive member A made by dispersing fine particles (emulsion-polymerized fine powder 0.32 $\mu$m in volume average diameter) of a fluorine-type resin (a tetrafluoroethylene-hexafluoropropylene copolymer) in the OPC outermost layer was used as an OPC drum. The particles accounted for 25% by weight of all OPC layer components.

A CAPA 700 centrifugal sedimentation particle size distribution meter (from HORIBA, Ltd.) was used to measure the volume average diameter of the fluorine-type resin particles.

In this Example, the upper limit pressure for preventing hollow images could be increased up to 15 N/cm$^2$. In addition, the transfer efficiency, which is defined by the above-described equation, could be increased to 95% by weight or more as a secondary advantage. Therefore, the volume of the cleaner may be small.

Because a transfer roller which has an Asker-C hardness of 50 can be used, solid rubber can be used. This may control the effect of stress on rubber in the process for producing the transfer roller, thereby increasing the productivity. (When rubber is stressed, its resistance typically changes, resulting in unstable resistance.)

What is claimed is:

1. An image forming apparatus, comprising:

(i) an electrostatic image bearing member for bearing an electrostatic image;

(ii) developing means having a toner for forming a toner image by developing said electrostatic image borne by the electrostatic image bearing member; and (iii) transferring means for transferring the toner image from the electrostatic image bearing member onto transfer material, wherein particles constituting the toner are 4 to 12 $\mu$m in weight average diameter, and in a circularity distribution for particles 3 $\mu$m or more in circle equivalent diameter which are included in the toner, particles having a circularity a of 0.90 or more account for 90% by number or more, the circularity a being given by the following formula:

$$\text{Circularity } a = \frac{L_0}{L}$$

where $L_0$: The circumference of a circle which has the same projected area as a particle image, L: The perimeter of the particle image, and the transferring means has a transfer roller which is in contact with the surface of the electrostatic image bearing member and rotates as the electrostatic image bearing member moves, wherein the transfer roller is in contact under a pressure of 0.5 to 10 N/cm$^2$ with the electrostatic image bearing member.

2. The image forming apparatus according to claim 1, wherein in the circularity distribution for the particles 3 $\mu$m or more in circle-equivalent diameter which are included in the toner, the particles having a circularity a of 0.90 or more account for 92% by number or more.

3. The image forming apparatus according to claim 1, wherein in the circularity distribution for the particles 3 $\mu$m or more in circle-equivalent diameter which are included in the toner, the particles having a circularity a of 0.90 or more account for 95% by number or more.

4. The image forming apparatus according to claim 1, wherein the toner includes toner particles and hydrophobic fine silica powder.

5. The image forming apparatus according to claim 1, wherein the transfer roller has an Asker-C hardness of 25 to 70.

6. The image forming apparatus according to claim 1, wherein the transfer roller is in contact under a pressure of 0.56 to 2.30 N/cm$^2$ with the electrostatic image bearing member.

7. The image forming apparatus according to claim 1, wherein the toner includes 30% by number or less of particles which are 3.17 $\mu$m or less in diameter.

8. The image forming apparatus according to claim 1, wherein the particles constituting the toner are 4 to 9 $\mu$m in weight average diameter.

9. The image forming apparatus according to claim 8, wherein the toner includes 30% by number or less of particles which are 3.17 $\mu$m or less in diameter.

10. The image forming apparatus according to claim 1, wherein the particles constituting the toner are 4 to 8 $\mu$m in weight average diameter.

11. The image forming apparatus according to claim 10, wherein the toner includes 30% by number or less of particles which are 3.17 $\mu$m or less in diameter.

12. The image forming apparatus according to claim 1, wherein a circumferential speed of the transfer roller, which rotates as the electrostatic image bearing member moves, is 99 to 100% of a circumferential speed of said electrostatic image bearing member.

13. The image forming apparatus according to claim 1, wherein a shaft retainer of the transfer roller is 2 to 4 mm in radius.

14. The image forming apparatus according to claim 1, wherein a shaft retainer of the transfer 15 roller has a ball bearing.

15. The image forming apparatus according to claim 1, wherein the electrostatic image bearing member has fluorine or silicon atoms in its surface layer.

16. The image forming apparatus according to claim 1, wherein the electrostatic image bearing member has a fluorine or silicon compound in its surface layer.

17. The image forming apparatus according to claim 16, wherein the fluorine or silicon compound is in fine-particle form.

* * * * *

UNITED STATES PATENT AND TRADEMARK OFFICE

CERTIFICATE OF CORRECTION

PATENT NO. : 6,424,814 B2
DATED : July 23, 2002
INVENTOR(S) : Yasumasa Otsuka et al.

It is certified that error appears in the above-identified patent and that said Letters Patent is hereby corrected as shown below:

Title page,
FOREIGN PATENT DOCUMENTS,
"JP 36-10231 7/1936" should read -- JP 36-10231 7/1961 --;
"JP 42-023910 11/1942" should read -- JP 42-023910 11/1967 --;
"JP 43-24748 10/1943" should read -- JP 43-24748 10/1968 --;
"JP 56-1394510 4/1981" should read -- JP 56-39451 11/1981 --; and
"JP 56-61842 4/1984" should read -- 59-61842 4/1984 --.

Column 1,
Line 46, "I, to" should read -- 1, to --.

Column 4,
Line 7, "are" should read -- is --;
Line 33, "area/$\pi)^{1/}$" should read -- area/$\pi)^{½}$ --; and
Line 34, "$_2 \times 2$" should read -- $\times$ 2 --.

Column 7,
Line 18, "does" should read -- does not change --.

Column 8,
Line 22, "drum)1," should read -- drum) 1, --.

Column 9,
Line 48, "12 pm" should read -- 12 μm --.

Column 11,
Lines 31 and 47, "N/cm2" should read -- N/cm$^2$ --;
Line 49, "close" should read -- so close --; and
Line 51, "heat air" should read -- heat was needed to heat air --.

Column 12,
Line 43, "20" should be deleted; and
Line 54, "N/cm2" should read -- N/cm$^2$ --.

UNITED STATES PATENT AND TRADEMARK OFFICE

CERTIFICATE OF CORRECTION

PATENT NO. : 6,424,814 B2
DATED : July 23, 2002
INVENTOR(S) : Yasumasa Otsuka et al.

It is certified that error appears in the above-identified patent and that said Letters Patent is hereby corrected as shown below:

Column 14,
Line 43, "15" should be deleted.

Signed and Sealed this

Eighteenth Day of February, 2003

JAMES E. ROGAN
*Director of the United States Patent and Trademark Office*